US006206429B1

(12) United States Patent
Cull et al.

(10) Patent No.: US 6,206,429 B1
(45) Date of Patent: Mar. 27, 2001

(54) PRISMATIC PRINTING

(75) Inventors: Standale Joseph Cull, Dayton; Stephen D. Webendorfer, Miamisburg; Joseph V. Riccardella, Beavercreek; William H. Mowry, Jr., Dayton, all of OH (US)

(73) Assignee: The Standard Register Company, Dayton, OH (US)

( * ) Notice: Subject to any disclaimer, the term of this patent is extended or adjusted under 35 U.S.C. 154(b) by 0 days.

(21) Appl. No.: 09/487,078

(22) Filed: Jan. 19, 2000

(51) Int. Cl.[7] ..... B42D 15/00

(52) U.S. Cl. ..... 283/93; 283/58; 283/94; 283/114; 359/618; 359/640

(58) Field of Search ..... 283/57, 58, 93, 283/94, 107, 113, 114; 235/3, 379; 359/618, 640

(56) References Cited

U.S. PATENT DOCUMENTS

| | | | | |
|---|---|---|---|---|
| 4,462,866 | * | 7/1984 | Tooth et al. | 162/103 |
| 4,579,370 | * | 4/1986 | Corwin et al. | 283/72 |
| 5,149,140 | * | 9/1992 | Mowry, Jr. et al. | 283/93 |
| 5,197,765 | | 3/1993 | Mowry, Jr. et al. . | |
| 5,340,159 | | 8/1994 | Mowry, Jr. . | |
| 5,690,366 | * | 11/1997 | Luciano | 283/94 |
| 5,715,316 | | 2/1998 | Steenblik et al. . | |
| 5,823,576 | | 10/1998 | Lambert . | |
| 5,863,075 | * | 1/1999 | Rich et al. | 283/94 |
| 6,095,566 | * | 8/2000 | Yamamoto et al. | 283/94 |

* cited by examiner

*Primary Examiner*—A. L. Wellington
*Assistant Examiner*—Monica S. Carter
(74) *Attorney, Agent, or Firm*—Killworth, Gottman, Hagan & Schaeff, LLP

(57) ABSTRACT

A security document production scheme is presented for the creation of a security document including a prismatic multicolor security image. In accordance with one embodiment of the present invention, a security document is provided comprising a security image defined on a face of the document. The security image is defined along first and second dimensions by the superposition of a primary security image portion and a secondary security image portion. The primary security image portion is defined by security image elements of a first color. The secondary security image portion is defined by security image elements of a second color. The primary security image portion is arranged to include first, second, and third types of security image segments. The secondary security image portion is arranged to include first, second, and third types of security image segments. The first type of security image segment defines an image element tone that decreases in magnitude along the first dimension of the security image and that maintains a substantially constant magnitude along the second dimension of the security image. The second type of security image segment defines an image element tone that decreases in magnitude along the second dimension of the security image and that maintains a substantially constant magnitude along the first dimension of the security image. The third type of security image segment defines an image element tone that maintains a substantially constant magnitude along the first and second dimensions of the security image. The primary security image portion and the secondary security image portion are superposed such that (i) security image segments of the first type in the primary security image portion are superposed with security image segments of the third type in the secondary image portion, (ii) security image segments of the second type in the primary security image portion are superposed with security image segments of the second type in the secondary image portion, and (iii) security image segments of the third type in the primary security image portion are superposed with security image segments of the first type in the secondary image portion.

20 Claims, 5 Drawing Sheets

20
22
24''
26
24'
22
16
18
A
B
B
C
C
D
D
E
A
B
(A+B)/2
B
(B+C)/2
C
(C+D)/2
D
(D+E)/2
E
0
0
0

PRISMATIC PRINTING

BACKGROUND OF THE INVENTION

The present invention relates to security documents including a security image composed of a printed security image and a printed complementary security image. The security image is arranged to provide an indication of document authenticity.

Conventional security documents comprise a security image including security image elements designed such that an attempted duplication or reproduction results in the formation of a readily apparent warning image on the face of the duplicate document. The security image elements are arranged such that the presence of the warning image is not readily apparent on the original. Examples of security documents of this type are illustrated in U.S. Pat. Nos. 4,579,370, 5,149,140, 5,197,765, 5,340,159, the disclosures of which are incorporated herein by reference.

Some conventional security documents are printed in two or more colors that are blended to achieve a smooth transition from one color to the next. This is commonly achieved through the use of a split fountain, i.e., a print unit with special dividers which separate one color from another. The split fountain technique is, however, troublesome in some instances because it is typically difficult to control print quality and requires frequent production stoppages for cleaning and other related maintenance.

Accordingly, there is a need for a security document production scheme that enables efficient creation of a security document including a multi-color security image where the colors blend together in an aesthetically pleasing manner. Further, there is a need for a multi-color security document production scheme that avoids conventional difficulties related to printing multi-color documents.

BRIEF SUMMARY OF THE INVENTION

This need is met by the present invention wherein a security document production scheme is presented for the creation of a security document including a prismatic multi-color security image. In accordance with one embodiment of the present invention, a security document is provided comprising a security image defined on a face of the document. The security image is defined along first and second dimensions by the superposition of a primary security image portion and a secondary security image portion. The primary security image portion is defined by security image elements of a first color. The secondary security image portion is defined by security image elements of a second color. The primary security image portion is arranged to include first, second, and third types of security image segments. The secondary security image portion is arranged to include first, second, and third types of security image segments. The first type of security image segment defines an image element tone that decreases in magnitude along the first dimension of the security image and that maintains a substantially constant magnitude along the second dimension of the security image. The second type of security image segment defines an image element tone that decreases in magnitude along the second dimension of the security image and that maintains a substantially constant magnitude along the first dimension of the security image. The third type of security image segment defines an image element tone that maintains a substantially constant magnitude along the first and second dimensions of the security image. The primary security image portion and the secondary security image portion are superposed such that (i) security image segments of the first type in the primary security image portion are superposed with security image segments of the third type in the secondary image portion, (ii) security image segments of the second type in the primary security image portion are superposed with security image segments of the second type in the secondary image portion, and (iii) security image segments of the third type in the primary security image portion are superposed with security image segments of the first type in the secondary image portion.

The security image segments of the first, second, and third types are preferably arranged along the second dimension in adjacent columns of common image element types. The columns of common image element types may be arranged such that: (i) the primary security image portion comprises, in succession, at least one column of security image segments of the first type, at least one column of security image segments of the second type, at least one column of security image segments of the third type, at least one column of security image segments of the second type, and at least one column of security image segments of the first type; and (ii) the secondary security image portion comprises, in succession, at least one column of security image segments of the third type, at least one column of security image segments of the second type, at least one column of security image segments of the first type, at least one column of security image segments of the second type, and at least one column of security image segments of the third type.

The second type of security image segment preferably includes a set of basic second type security image segments and a set of reversed second type security image segments. The reversed security image segments define an image element tone that varies in a direction opposite to a varying tone direction defined by the basic security image segments.

The columns of common image element types may be arranged such that: (i) the primary security image portion comprises, in succession, at least one column of security image segments of the first type, at least one column of security image segments of the basic second type, at least one column of security image segments of the third type, at least one column of security image segments of the reversed second type, and at least one column of security image segments of the first type; and (ii) the secondary security image portion comprises, in succession, at least one column of security image segments of the third type, at least one column of security image segments of the reversed second type, at least one column of security image segments of the first type, at least one column of security image segments of the basic second type, and at least one column of security image segments of the third type.

The security image segments may be arranged such that the adjacent columns of common image element types comprise columns of generally diagonal orientation relative to the first and second dimensions.

The first type of security image segments are preferably arranged in at least one selected column such that the selected column as a whole defines an image element tone that decreases in magnitude along the first dimension of the security image. The image element tone of the selected column of the first type of security image segments decreases in value from a maximum tone at a top edge of the security image to a minimum tone at a bottom edge of the security image. The image element tone of the selected column of the first type of security image segments preferably decreases in value from a maximum tone at a top edge of an uppermost security image segment in the security image to a lower tone at a bottom edge of the uppermost security image segment, and the image element tone of successively lower security image segments in the selected column preferably decrease in value from a lower tone defined at a bottom edge of a preceding security image segment in the selected column to a successively lower tone at a successive bottom edge of the successively lower security image segment.

The second type of security image segments are preferably arranged in at least one selected column such that the selected column as a whole defines an image element tone that decreases in magnitude along the first and second dimensions of the security image. The image element tone of the selected column of the second type of security image segments preferably decreases in value from an intermediate tone at a top edge of the security image to a minimum tone at a bottom edge of the security image and from an intermediate tone at a first side edge of the selected column to the minimum tone at a second side edge of the selected column. The third type of security image segments are preferably arranged in at least one selected column such that the selected column as a whole defines a substantially constant image element tone corresponding to the minimum tonal value of the second side edge of the selected column. The selected column of the third type of security image segments is preferably positioned adjacent the second side edge of the selected column of the second type of security image segments.

The third type of security image segments are arranged in at least one selected column such that the selected column as a whole defines a substantially constant image element tone.

In accordance with another embodiment of the present invention, a security document is provided wherein the security image is defined along first and second dimensions by the superposition of a primary security image portion and a secondary security image portion. The primary security image portion is defined by security image elements of a first color. The secondary security image portion is defined by security image elements of a second color. The primary security image portion includes security image segments arranged in a primary two dimensional array. The secondary security image portion includes security image segments arranged in a secondary two dimensional array. The primary and secondary two dimensional arrays include a plurality of rows and columns of security image segments. The rows and columns of the primary two dimensional array are aligned with the rows and columns of the secondary two dimensional array.

A first row security image segment in a first column of the primary array defines an image element tone that decreases in magnitude along the first dimension from tonal value A to a lower tonal value B and that maintains a substantially constant magnitude along the second dimension of the security image. Successive row security image segments in the first column of the primary array define successive image element tones that decrease in magnitude along the first dimension from a tonal value m to a lower tonal value n and that maintain a substantially constant magnitude along the second dimension of the security image, where the tonal value m is equal to a lower tonal value defined in the preceding security image segment in the first column.

A first row security image segment in a second column of the primary array defines an image element tone that decreases in magnitude along the second dimension from a tonal value i to a minimum tonal value and that maintains a substantially constant magnitude i along the first dimension of the security image, where i is a value that is greater than the lower tonal value B and less than the tonal value A. Successive row security image segments in the second column of the primary array define successive image element tones that decrease in magnitude along the second dimension from a tonal value j to the minimum tonal value and that maintain a substantially constant magnitude j along the first dimension of the security image, where j is a value that is greater than the lower tonal value n and less than the tonal value m of a corresponding adjacent column successive row.

A first row security image segment in a third column of the primary array defines an image element tone that maintains a substantially constant magnitude along the first and second dimensions at the minimum tonal value. Successive row security image segments in the third column of the primary array define successive image element tones that maintain a substantially constant magnitude along the first and second dimensions at the minimum tonal value.

A first row security image segment in a fourth column of the primary array defines an image element tone that increases in magnitude along the second dimension from the minimum tonal value to the tonal value i and that maintains a substantially constant magnitude i along the first dimension of the security image, where i is a value that is greater than the lower tonal value B and less than the tonal value A. Successive row security image segments in the fourth column of the primary array define successive image element tones that increase in magnitude along the second dimension from the minimum tonal value to the tonal value j and that maintain a substantially constant magnitude j along the first dimension of the security image, where j is a value that is greater than the lower tonal value n and less than the tonal value m of a corresponding adjacent column successive row.

A first row security image segment in a fifth column of the primary array defines an image element tone that decreases in magnitude along the first dimension from the tonal value A to the lower tonal value B and that maintains a substantially constant magnitude along the second dimension of the security image. Successive row security image segments in the first column of the primary array define successive image element tones that decrease in magnitude along the first dimension from the tonal value m to the lower tonal value n and that maintain a substantially constant magnitude along the second dimension of the security image, where the tonal value m is equal to a lower tonal value defined in the preceding security image segment in the first column.

A first row security image segment in a first column of the secondary array defines an image element tone that maintains a substantially constant magnitude along the first and second dimensions at the minimum tonal value. Successive row security image segments in the first column of the secondary array define successive image element tones that maintain a substantially constant magnitude along the first and second dimensions at the minimum tonal value.

A first row security image segment in a second column of the secondary array defines an image element tone that increases in magnitude along the second dimension from the minimum tonal value to the tonal value i and that maintains a substantially constant magnitude i along the first dimension of the security image, where i is a value that is greater than the lower tonal value B and less than the tonal value A. Successive row security image segments in the second column of the secondary array define successive image element tones that increase in magnitude along the second dimension from the minimum tonal value to the tonal value j and that maintain a substantially constant magnitude j along the first dimension of the security image, where j is a value that is greater than the lower tonal value n and less than the tonal value m of a corresponding adjacent column successive row.

A first row security image segment in a third column of the secondary array defines an image element tone that decreases in magnitude along the first dimension from the tonal value A to the lower tonal value B and that maintains a substantially constant magnitude along the second dimension of the security image. successive row security image segments in the third column of the secondary array define successive image element tones that decrease in magnitude along the first dimension from the tonal value m to the lower tonal value n and that maintain a substantially constant magnitude along the second dimension of the security image, where the tonal value m is equal to a lower tonal value defined in the preceding security image segment in the first column.

A first row security image segment in a fourth column of the secondary array defines an image element tone that decreases in magnitude along the second dimension from the tonal value i to the minimum tonal value and that maintains a substantially constant magnitude i along the first dimension of the security image, where i is a value that is greater than the lower tonal value B and less than the tonal value A. Successive row security image segments in the fourth column of the secondary array define successive image element tones that decrease in magnitude along the second dimension from the tonal value j to the minimum tonal value and that maintain a substantially constant magnitude j along the first dimension of the security image, where j is a value that is greater than the lower tonal value n and less than the tonal value m of a corresponding adjacent column successive row.

A first row security image segment in a fifth column of the secondary array defines an image element tone that maintains a substantially constant magnitude along the first and second dimensions at the minimum tonal value. Successive row security image segments in the fifth column of the secondary array define successive image element tones that maintain a substantially constant magnitude along the first and second dimensions at the minimum tonal value.

The primary array preferably defines at least four rows and the tonal value m decreases from the tonal value B in a second row of the first column of the primary array to a tonal value C in a third row of the first column of the primary array to a tonal value D in a fourth row of the first column of the primary array. The tonal value n decreases from the tonal value C in a second row of the first column of the primary array to the tonal value D in a third row of the first column of the primary array to a tonal value E in a fourth row of the first column of the primary array. More specifically, in one embodiment of the present invention, the tonal value i is substantially equal to (A+B)/2 and the successively lower tonal values j are substantially equal to (B+C)/2, (C+D)/2, and (D+E)/2. The tonal value E and the minimum tonal value are preferably substantially equal to zero.

In accordance with yet another embodiment of the present invention, a security document processing system is provided comprising a document issuing station and at least one document receiving station. A prismatic security document according to the present invention originates at the document issuing station and is routed to the document receiving station. The hidden warning message embedded in the security document provides an indication of document validity within the document processing system.

Accordingly, it is an object of the present invention to provide a security document production scheme for the production and use of a security document including a prismatic multi-color security image. Other objects of the present invention will be apparent in light of the description of the invention embodied herein.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF THE PREFERRED EMBODIMENTS

Figure 1:
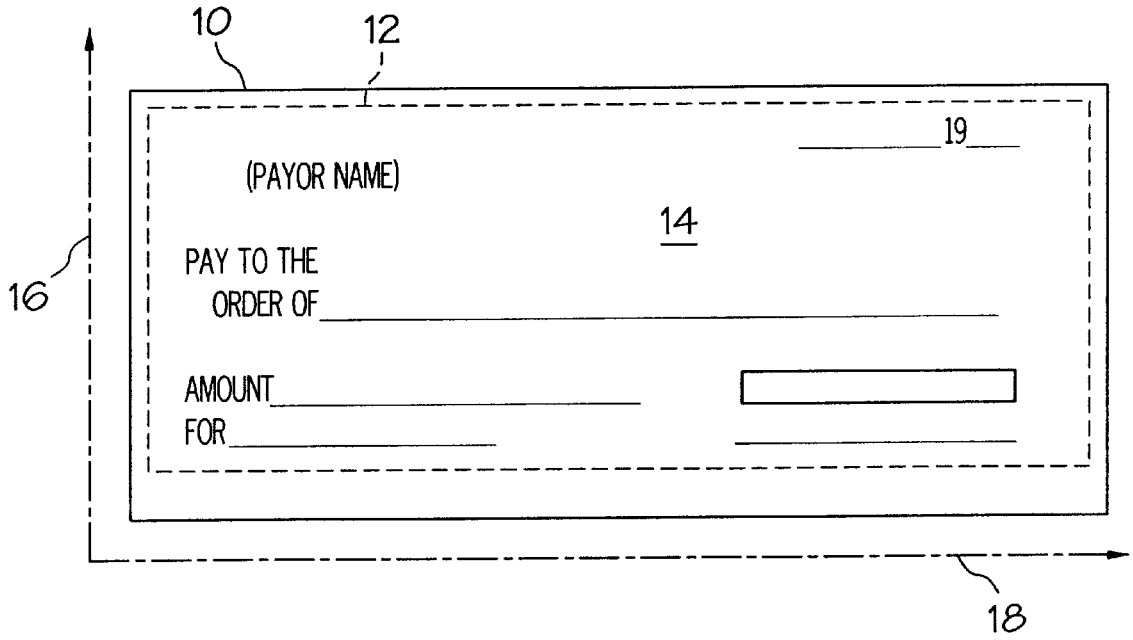
FIG. 1 is a schematic illustration of a security document according to the present invention.
Figure 2:
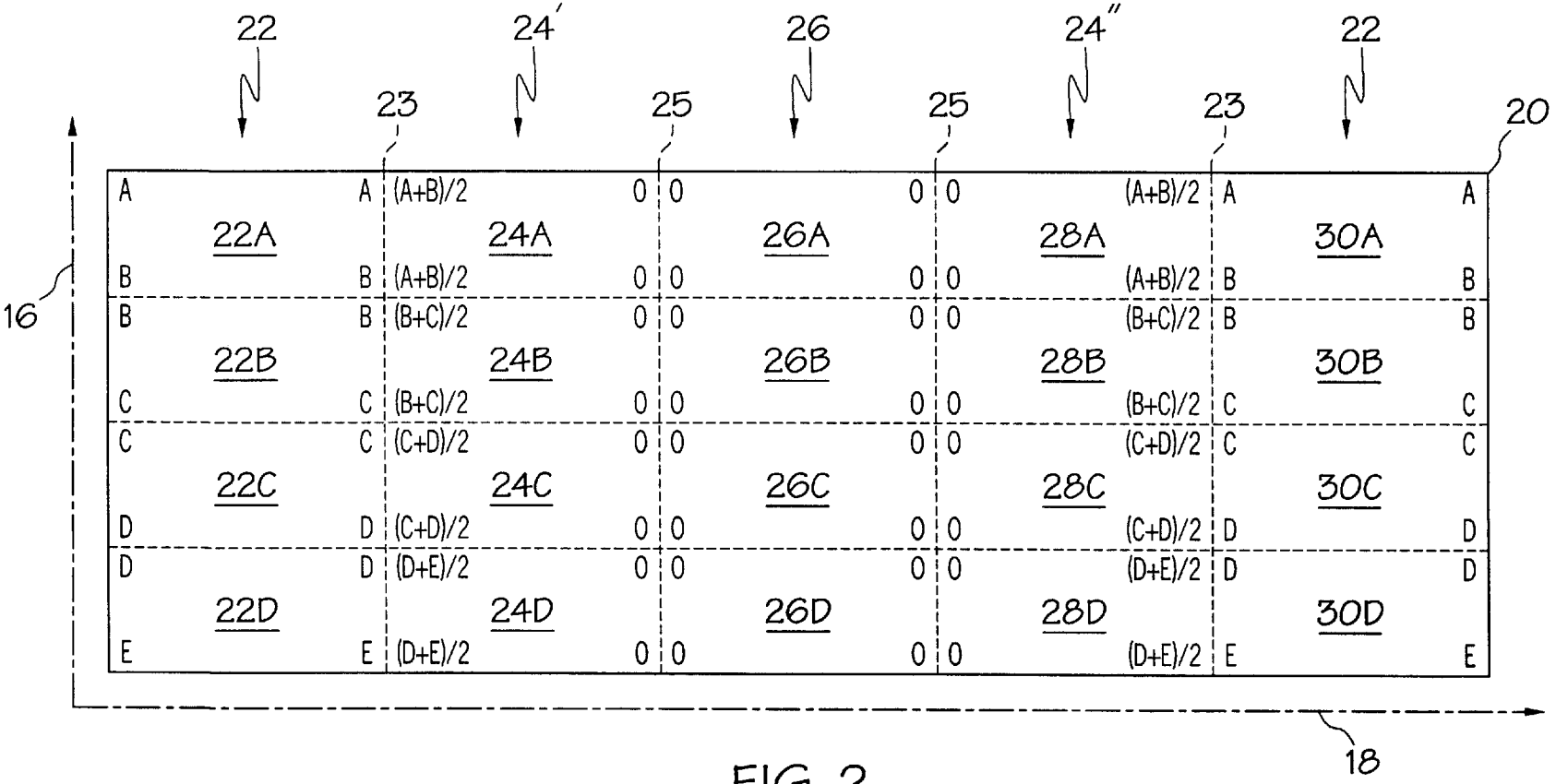
FIG. 2 is a schematic illustration of a primary security image portion of a security document according to the present invention.
Figure 3:
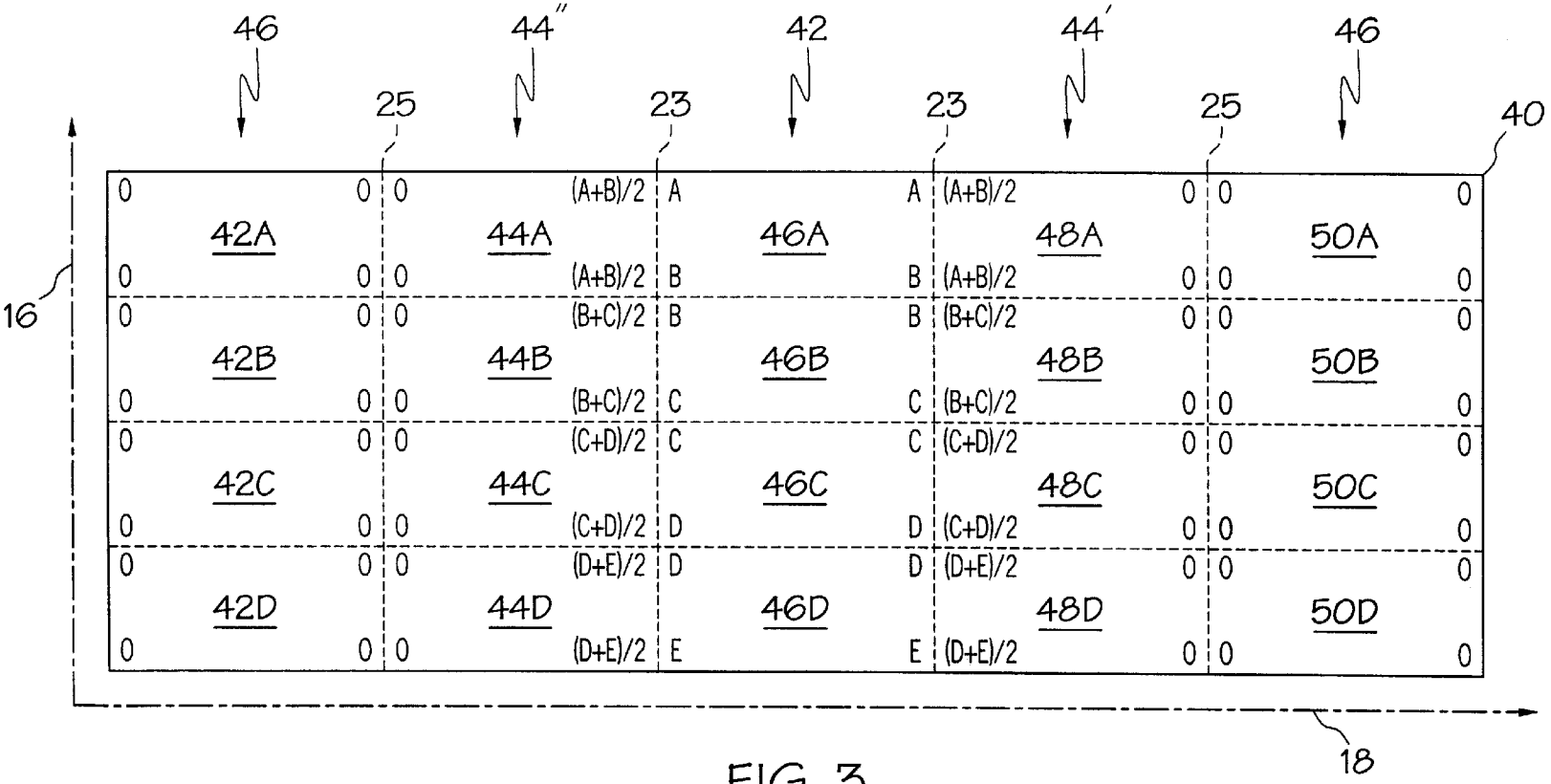
FIG. 3 is a schematic illustration of a secondary security image portion of a security document according to the present invention.

Referring initially to the embodiment of the present invention illustrated in FIGS. 1–3, a security document 10 according to the present invention comprises a security image 12 defined on a face 14 of the document 10. The security image 12, which is described in further detail herein with reference to FIGS. 2 and 3, is defined along first and second dimensions 16, 18 of the security document 10. The security image 12 is defined by the superposition of a primary security image portion 20 and a secondary security image portion 40.

The primary security image portion 20 is illustrated in FIG. 2 and is defined by security image elements of a first color, e.g., red dots, blue dots, green dots, etc. The secondary security image portion 40 is illustrated in FIG. 3 and is defined by security image elements of a second color. The specific color, shape, and size of the security image elements are not the subject of the present invention. Suitable image element colors, sizes, and shapes may be gleaned from notoriously well known conventional security document technology.

The primary and secondary security image portions 20, 40 are arranged to include three general types of security image segments. Each type of security image segment is arranged along the second dimension 18 of the security image 12 in adjacent columns of common image element type. Stated differently, each column in the primary security image portion 20 includes security image segments of only one type and each column in the secondary security image portion 40 includes security image segments of only one type.

Referring to FIGS. 2 and 3, in the primary security image portion 20, the first type of security image segments 22 are arranged in the far left and far right columns of the primary security image 20. In contrast, in the secondary security image portion 40, the first type of security image segments 42 are arranged in the central column of the secondary security image 40. Similarly, in the secondary security image portion 40, the third type of security image segments 46 are arranged in the far left and far right columns of the secondary security image 40. In contrast, in the primary security image portion 20, the third type of security image segments 26 are arranged in the central column of the primary security image 20. The second type of security image segments 24', 24", 44', 44" are arranged in FIGS. 2 and 3 in an analogous manner, as is described in further detail herein.

Those practicing the present invention should take special note that reference numbers 42 and 46 are not misplaced in FIG. 3 and that the reference numbers that relate to the various image segment types are not intended to correspond to the specific security image segment numbers introduced in the figures. For example, in FIG. 3, reference number 42, representing security image segments of the first type, does not correspond to the numbers selected for the central row of security image segments 46A, 46B, 46C, 46D.

The first type of security image segment 22, 42 defines an image element tone that decreases in magnitude along the first dimension 16 of the security image 12 and that maintains a substantially constant magnitude along the second dimension 18 of the security image 12. As is illustrated in FIGS. 2 and 3, the first type of security image segments 22, 42 are arranged in a column and their respective tonal values are selected such that the selected column as a whole defines an image element tone that decreases in magnitude along the first dimension 16 of the security image 12. More specifically, the image element tone of the selected column of the first type of security image segments 22, 42 decreases in value from a maximum tone A at a top edge of the security image to a minimum tone E at a bottom edge of the security image. The image element tone decreases in value from the maximum tone A at a top edge of the uppermost security image segment 22A. 46A to a lower tone B at a bottom edge of the uppermost security image segment 22A, 46A. The image element tone of successively lower security image segments 22B,22C, 22D & 46B, 46C, 46D decreases in value from a lower tone m defined at a bottom edge of a preceding security image segment in the selected column to a successively lower tone n at a successive bottom edge of the successively lower security image segment. In the embodiment of FIGS. 1–3, m=B and n=C in security image segment 22B, 46B, m=C and n=D in security image segment 22C, 46C and m=D and n=E in security image segment 22D, 46D.

The second type of security image segment 24', 24", 44', 44" defines an image element tone that decreases in magnitude along the second dimension 18 of the security image 12 and that maintains a substantially constant magnitude along the first dimension 16 of the security image 12. The second type of security image segment 24', 24", 44', 44" actually includes a set of basic second type security image segments 24', 44' and a set of reversed second type security image segments 24", 44". The reversed security image segments 24", 44" define an image element tone that varies in a direction opposite to a varying tone direction defined by the basic security image segments 24', 44'. In this manner, the tone of the security image may be arranged to vary continuously across the face 14 of the security document 10 from dark to light or light to dark.

As is further illustrated in FIGS. 2 and 3, the second type of security image segments 24', 24", 44', 44" are arranged in a column such that the selected column as a whole defines an image element tone that decreases in magnitude along the first and second dimensions 16, 18 of the security image 12. More specifically, the image element tone decreases in value from an intermediate tone at a top edge of the security image 12 to the minimum tone at a bottom edge of the security image 12 and from an intermediate tone at a first side edge 23 of the column to the minimum tone at a second side edge 25 of the column. In the illustrated embodiment, the tonal value E and the minimum tonal value are substantially equal to zero.

The third type of security image segment 26, 46 defines an image element tone that maintains a substantially constant magnitude along the first and second dimensions of the security image 12. The third type of security image segments 26, 46 are arranged in a column that is adjacent to the second side edge 25 of the column that includes the second type of security image segments 24', 24", 44', 44". The column as a whole defines a substantially constant image element tone corresponding to the minimum tonal value at the second side edge of the adjacent column.

The primary security image portion 20 and the secondary security image portion 40 are superposed to form the security image 12. More specifically, the primary security image portion 20 and the secondary security image portion 40 are superposed as follows: (i) security image segments of the first type 22 in the primary security image portion 20 are superposed with security image segments of the third type 46 in the secondary image portion 40; (ii) security image segments of the second type 24', 24" in the primary security image portion 20 are superposed with security image segments of the second type 44", 44' in the secondary image portion 40; and (iii) security image segments of the third type 26 in the primary security image portion 20 are superposed with security image segments of the first type 42 in the secondary image portion 40.

In the embodiment of the present invention illustrated in FIGS. 1–3, the columns of common image element types are arranged such that the primary security image portion 20 comprises, in succession, a column of security image segments of the first type 22, a column of security image segments of the basic second type 24', a column of security image segments of the third type 26, a column of security image segments of the reversed second type 24", and a column of security image segments of the first type 22. The secondary security image portion 40 comprises, in succession, a column of security image segments of the third type 46, a column of security image segments of the reversed second type 44", a column of security image segments of the first type 42, a column of security image segments of the basic second type 44', and a column of security image segments of the third type 46. It is contemplated by the present invention that additional columns of the various security image element types may be added to any part of the security image 12, as long as an overall gradual prismatic color change is preserved. Alternatively, any of the illustrated segment columns may be divided into sub-columns that collectively form the image tone of the original column.

The security document of the present invention is well suited for incorporation of any of a number of conventional security features commonly associated with hidden message security documents. Specifically, the primary and secondary security image portions 20, 40 may be arranged to incorporate a hidden "VOID" term in each of the security image segments. As will be appreciated by those practicing the present invention, the tone of the hidden term is preferably selected to match the specific image element tone, including any increases or decreases in the image element tone within the individual segments.

FIGS. 2 and 3 illustrate image portion columns of approximately equal width. However, in certain embodiments of the present invention it is preferable to arrange the far left, center, and far right columns such that their widths are approximately twice that of the other two columns. Where these different width columns are used, and where it is desired to maintain the proportions of the dimensions of the above-noted "VOID" term, a pair of smaller "VOIDs" may be stacked, one above the other, to substantially fill the area of the narrower segments. Alternatively, the "VOIDs" may simply be omitted from the narrower segments.

A more detailed description of the security image according to the present invention may be given with reference to the values and variables presented in the individual security image segments illustrated in FIGS. 2 and 3. As is noted above, the first row security image segment 22A in the first column of the primary array 20 defines an image element tone that decreases in magnitude along the first dimension 16 from tonal value A to a lower tonal value B and that maintains a substantially constant magnitude along the second dimension 18 of the security image 12. Successive row security image segments 22B, 22C, 22D in the first column of the primary array 20 define successive image element tones that decrease in magnitude along the first dimension from a tonal value m to a lower tonal value n and that maintain a substantially constant magnitude along the second dimension of the security image. The tonal value m is equal to the lower tonal value defined in the preceding security image segment in the first column. In the embodiment of FIGS. 1–3, m=B and n=C in security image segment 22B, m=C and n=D in security image segment 22C, and m=D and n=E in security image segment 22D.

The first row security image segment 24A in the second column of the primary array 20 defines an image element tone that decreases in magnitude along the second dimension 18 from a tonal value i to the minimum tonal value and that maintains a substantially constant magnitude i along the first dimension 16 of the security image 12. The magnitude of i is greater than the lower tonal value B and less than the tonal value A. Successive row security image segments 24B, 24C, 24D in the second column of the primary array 20 define successive image element tones that decrease in magnitude along the second dimension from a tonal value j to the minimum tonal value and that maintain a substantially constant magnitude j along the first dimension of the security image, where j is a value that is greater than the lower tonal value n and less than the tonal value m of a corresponding adjacent column successive row. In the embodiment of FIGS. 1–3, i is substantially equal to (A+B)/2 in security image segment 24A,j is substantially equal to (B+C)/2 in security image segment 24B,j is substantially equal to (C+D)/2 in security image segment 24C, and j is substantially equal to (D+E)/2 in security image segment 24D.

The security image segments 26A, 26B, 26C, 26D in the third column of the primary array 20 define an image element tone that maintains a substantially constant magnitude along the first and second dimensions 16, 18 at the minimum tonal value.

The first row security image segment 28A in the fourth column of the primary array 20 defines an image element tone that increases in magnitude along the second dimension 18 from the minimum tonal value to a tonal value i and that maintains a substantially constant magnitude i along the first dimension 16 of the security image 12. The magnitude of i is greater than the lower tonal value B and less than the tonal value A. Successive row security image segments 28B, 28C, 28D in the fourth column of the primary array 20 define successive image element tones that increase in magnitude along the second dimension from the minimum tonal value to a tonal value j and that maintain a substantially constant magnitude j along the first dimension of the security image, where j is a value that is greater than the lower tonal value n and less than the tonal value m of a corresponding successive row in the fifth column. In the embodiment of FIGS. 1–3, i is substantially equal to (A+B)/2 in security image segment 28A,j is substantially equal to (B+C)/2 in security image segment 28B,j is substantially equal to (C+D)/2 in security image segment 28C, and j is substantially equal to (D+E)/2 in security image segment 28D.

A first row security image segment 30A in a fifth column of the primary array 20 defines an image element tone that decreases in magnitude along the first dimension 16 from tonal value A to a lower tonal value B and that maintains a substantially constant magnitude along the second dimension 18 of the security image 12. Successive row security image segments 30B, 30C, 30D in the fifth column of the primary array 20 define successive image element tones that decrease in magnitude along the first dimension from a tonal value m to a lower tonal value n and that maintain a substantially constant magnitude along the second dimension 18 of the security image 12. The tonal value m is equal to the lower tonal value defined in the preceding security image segment in the fifth column. In the embodiment of FIGS. 1–3, m=B and n=C in security image segment 30B, m=C and n=D in security image segment 30C, and m=D and n=E in security image segment 30D.

The segments of the secondary array 40 are arranged in a similar manner as those in the primary array 20, with the exception that the order of the columns is different than that of the primary array 20. Specifically, the image segments 42A, 42B, 42C, 42D in the first column of the secondary array 40 define an image element tone that maintains a substantially constant magnitude along the first and second dimensions 16, 18 at the minimum tonal value. Similarly, the image segments 50A, 50B, 50C, 50D in the fifth column of the secondary array 40 define an image element tone that maintains a substantially constant magnitude along the first and second dimensions 16, 18 at the minimum tonal value.

The first row security image segment 44A in the second column of the secondary array 40 defines an image element tone that increases in magnitude along the second dimension 18 from the minimum tonal value to the tonal value i and that maintains a substantially constant magnitude i along the first dimension 16 of the security image 12. The magnitude of i is greater than the lower tonal value B and less than the tonal value A. Successive row security image segments 44B, 44C, 44D in the second column of the secondary array 20 define successive image element tones that increase in magnitude along the second dimension 18 from the minimum tonal value to a tonal value j and that maintain a substantially constant magnitude j along the first dimension 16 of the security image 12, where j is a value that is greater than the lower tonal value n and less than the tonal value m of a corresponding successive row in the third column. In the embodiment of FIGS. 1–3, i is substantially equal to (A+B)/2 in security image segment 44A,j is substantially equal to (B+C)/2 in security image segment 44B,j is substantially equal to (C+D)/2 in security image segment 44C, and j is substantially equal to (D+E)/2 in security image segment 44D.

The first row security image segment 46A in a third column of the secondary array 40 defines an image element tone that decreases in magnitude along the first dimension 16 from tonal value A to a lower tonal value B and that maintains a substantially constant magnitude along the second dimension 18 of the security image 12. Successive row security image segments 46B, 46C, 46D in the third column of the secondary array 20 define successive image element tones that decrease in magnitude along the first dimension from a tonal value m to a lower tonal value n and that maintain a substantially constant magnitude along the second dimension 18 of the security image 12. The tonal value m is equal to the lower tonal value defined in the preceding security image segment in the third column. In the embodiment of FIGS. 1–3, m=B and n=C in security image segment 46B, m=C and n=D in security image segment 46C, and m=D and n=E in security image segment 46D.

The first row security image segment 48A in the fourth column of the secondary array 40 defines an image element tone that decreases in magnitude along the second dimension 18 from a tonal value i to the minimum tonal value and that maintains a substantially constant magnitude i along the first dimension 16 of the security image 12. The magnitude of i is greater than the lower tonal value B and less than the tonal value A. Successive row security image segments 48B, 48C, 48D in the fourth column of the secondary image 40 define successive image element tones that decrease in magnitude along the second dimension 18 from a tonal value j to the minimum tonal value and that maintain a substantially constant magnitude j along the first dimension 16 of the security image 12, where j is a value that is greater than the lower tonal value n and less than the tonal value m of a corresponding adjacent column successive row. In the embodiment of FIGS. 1–3, i is substantially equal to (A+B)/2 in security image segment 48A, j is substantially equal to (B+C)/2 in security image segment 48B, j is substantially equal to (C+D)/2 in security image segment 48C, and j is substantially equal to (D+E)/2 in security image segment 48D. In the illustrated embodiment, the tonal value E and the minimum tonal value are substantially equal to zero.

Figure 4:
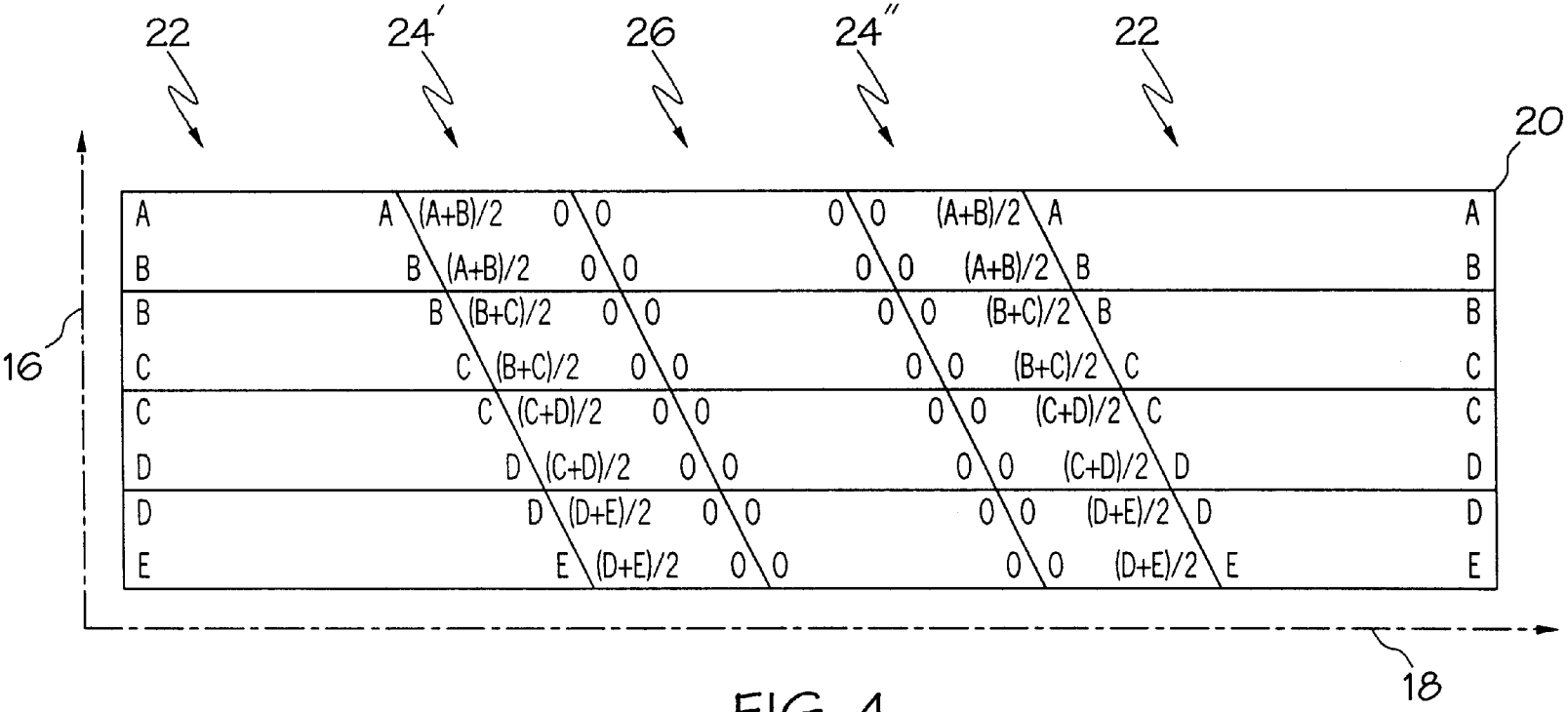
FIG. 4 is a schematic illustration of a primary security image portion of a security document according to an alternative embodiment of the present invention.
Figure 5:
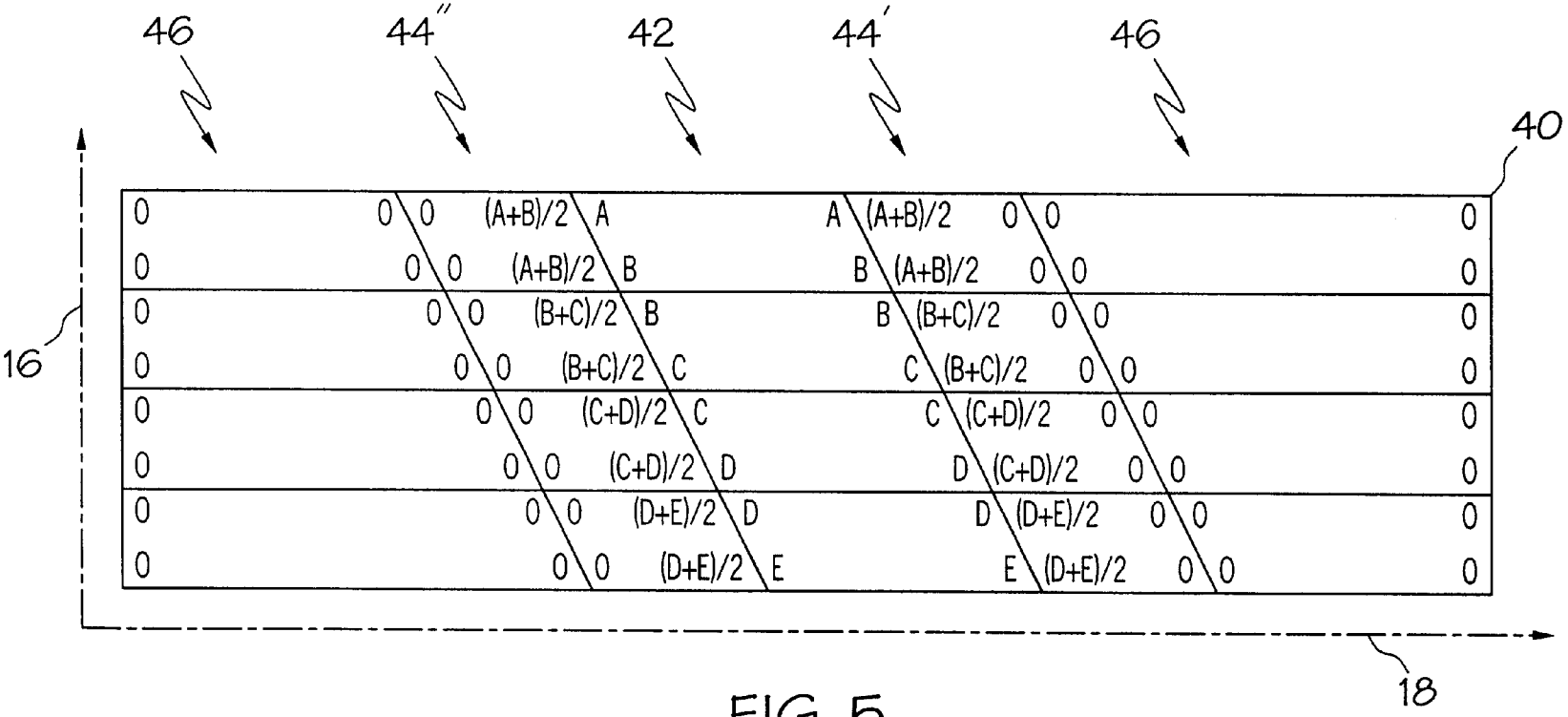
FIG. 5 is a schematic illustration of a secondary security image portion of a security document according to an alternative embodiment of the present invention.

Referring now to the embodiment of the present invention illustrated in FIGS. 4 and 5, the security image segments are arranged such that the adjacent columns of common image element types comprise columns of generally diagonal orientation. The specific tonal variations of each security image segment are analogous to the tonal variations of the embodiment illustrated in FIGS. 2 and 3, with the exception that specific image segment borders are diagonally skewed relative to the first and second dimensions 16, 18.

Having described the invention in detail and by reference to preferred embodiments thereof, it will be apparent that modifications and variations are possible without departing from the scope of the invention defined in the appended claims. For example, the specific number of image segment columns selected for use in the document production scheme of the present invention may vary from the five column arrangement illustrated in the figures. Further, the security document of the present invention is well suited for incorporation of any of a number of conventional security features commonly associated with hidden message security documents. Further still, the security document of the present invention is well suited for use in a security document processing system including a document issuing station and at least one document receiving station wherein a security document according to the present invention originates at the document issuing station and is routed to the document receiving station.

What is claimed is:

1. A security document comprising a security image defined on a face of said document, wherein:

said security image is defined along first and second dimensions by the superposition of a primary security image portion and a secondary security image portion;

said primary security image portion is defined by security image elements of a first color, said secondary security image portion is defined by security image elements of a second color;

said primary security image portion is arranged to include first, second, and third types of security image segments;

said secondary security image portion is arranged to include first, second, and third types of security image segments;

said first type of security image segment defines an image element tone that decreases along said first dimension of said security image and that is substantially constant along said second dimension of said security image;

said second type of security image segment defines an image element tone that decreases along said second dimension of said security image and that is substantially constant along said first dimension of said security image;

said third type of security image segment defines an image element tone that is substantially constant along said first and second dimensions of said security image; and said primary security image portion and said secondary security image portion are superposed such that (i) security image segments of said first type in said primary security image portion are superposed with security image segments of said third type in said secondary image portion, (ii) security image segments of said second type in said primary security image portion are superposed with security image segments of said second type in said secondary image portion, and (iii) security image segments of said third type in said primary security image portion are superposed with security image segments of said first type in said secondary image portion.

2. A security document as claimed in claim 1 wherein said security image segments of said first, second, and third types are arranged along said second dimension in adjacent columns of common image element types.

3. A security document as claimed in claim 2 wherein said columns of common image element types are arranged such that:

said primary security image portion comprises, in succession, at least one column of security image segments of said first type, at least one column of security image segments of said second type, at least one column of security image segments of said third type, at least one column of security image segments of said second type, and at least one column of security image segments of said first type; and said secondary security image portion comprises, in succession, at least one column of security image segments of said third type, at least one column of security image segments of said second type, at least one column of security image segments of said first type, at least one column of security image segments of said second type, and at least one column of security image segments of said third type.

4. A security document as claimed in claim 2 wherein said second type of security image segment includes a set of basic second type security image segments and a set of reversed second type security image segments, wherein said reversed security image segments define an image element tone that varies in a direction opposite to a varying tone direction defined by said basic security image segments, and wherein said columns of common image element types are arranged such that:

said primary security image portion comprises, in succession, at least one column of security image segments of said first type, at least one column of security image segments of said basic second type, at least one column of security image segments of said third type, at least one column of security image segments of said reversed second type, and at least one column of security image segments of said first type; and said secondary security image portion comprises, in succession, at least one column of security image segments of said third type, at least one column of security image segments of said reversed second type, at least one column of security image segments of said first type, at least one column of security image segments of said basic second type, and at least one column of security image segments of said third type.

5. A security document as claimed in claim 2 wherein said security image segments are arranged such that said adjacent columns of common image element types comprise columns of generally diagonal orientation relative to said first and second dimensions.

6. A security document as claimed in claim 2 wherein said first type of security image segments are arranged in at least one selected column such that said selected column as a whole defines an image element tone that decreases along said first dimension of said security image.

7. A security document as claimed in claim 6 wherein said image element tone of said selected column of said first type of security image segments decreases from a maximum tone at a top edge of said security image to a minimum tone at a bottom edge of said security image.

8. A security document as claimed in claim 6 wherein said image element tone of said selected column of said first type of security image segments decreases from a maximum tone at a top edge of an uppermost security image segment in said security image to a lower tone at a bottom edge of said uppermost security image segment, and wherein said image element tone of successively lower security image segments in said selected column decreases from a lower tone defined at a bottom edge of a preceding security image segment in said selected column to a successively lower tone at a successive bottom edge of said successively lower security image segment.

9. A security document as claimed in claim 2 wherein said second type of security image segments are arranged in at least one selected column such that said selected column as a whole defines an image element tone that decreases along said first and second dimensions of said security image.

10. A security document as claimed in claim 9 wherein said image element tone of said selected column of said second type of security image segments decreases from an intermediate tone at a top edge of said security image to a minimum tone at a bottom edge of said security image and from an intermediate tone at a first side edge of said selected column to said minimum tone at a second side edge of said selected column.

11. A security document as claimed in claim 10 wherein:

said third type of security image segments are arranged in at least one selected column such that said selected column as a whole defines a substantially constant image element tone corresponding to said minimum tonal value of said second side edge of said selected column; and said selected column of said third type of security image segments is positioned adjacent said second side edge of said selected column of said second type of security image segments.

12. A security document as claimed in claim 2 wherein said third type of security image segments are arranged in at least one selected column such that said selected column as a whole defines a substantially constant image element tone.

13. A security document comprising a security image defined on a face of said document, wherein:

said security image is defined along first and second dimensions by the superposition of a primary security image portion and a secondary security image portion;

said primary security image portion is defined by security image elements of a first color;

said secondary security image portion is defined by security image elements of a second color;

said primary security image portion is arranged to include first, second, and third types of security image segments;

said secondary security image portion is arranged to include first, second, and third types of security image segments;

said first type of security image segment defines an image element tone that decreases along said first dimension of said security image and that is substantially constant along said second dimension of said security image;

said second type of security image segment defines an image element tone that decreases along said second dimension of said security image and that is substantially constant along said first dimension of said security image;

said third type of security image segment defines an image element tone that is substantially constant along said first and second dimensions of said security image;

said primary security image portion and said secondary security image portion are superposed such that (i) security image segments of said first type in said primary security image portion are superposed with security image segments of said third type in said secondary image portion, (ii) security image segments of said second type in said primary security image portion are superposed with security image segments of said second type in said secondary image portion, and (iii) security image segments of said third type in said primary security image portion are superposed with security image segments of said first type in said secondary image portion;

said security image segments of said first, second, and third types are arranged in adjacent columns of common image element types, and said adjacent columns of common image element types comprise columns of generally diagonal orientation relative to said first and second dimensions.

14. A security document comprising a security image defined on a face of said document, wherein:

said security image is defined along first and second dimensions by the superposition of a primary security image portion and a secondary security image portion; said primary security image portion is defined by security image elements of a first color;

said secondary security image portion is defined by security image elements of a second color;

said primary security image portion includes security image segments arranged in a primary two dimensional array;

said secondary security image portion includes security image segments arranged in a secondary two dimensional array;

said primary and secondary two dimensional arrays include a plurality of rows and columns of security image segments;

said rows and columns of said primary two dimensional array are aligned with said rows and columns of said secondary two dimensional array;

a first row security image segment in a first column of said primary array defines an image element tone that decreases along said first dimension from tonal value A to a lower tonal value B and that is substantially constant along said second dimension of said security image;

successive row security image segments in said first column of said primary array define successive image element tones that decrease along said first dimension from a tonal value m to a lower tonal value n and that are substantially constant along said second dimension of said security image, where said tonal value m is equal to a lower tonal value defined in the preceding security image segment in said first column;

a first row security image segment in a second column of said primary array defines an image element tone that decreases along said second dimension from a tonal value i to a minimum tonal value and that is substantially constant along said first dimension of said security image, where i is a value that is greater than said lower tonal value B and less than said tonal value A;

successive row security image segments in said second column of said primary array define successive image element tones that decrease along said second dimension from a tonal value j to said minimum tonal value and that are substantially constant along said first dimension of said security image, where j is a value that is greater than said lower tonal value n and less than said tonal value m of a corresponding adjacent column successive row;

a first row security image segment in a third column of said primary array defines an image element tone that is substantially constant along said first and second dimensions at said minimum tonal value;

successive row security image segments in said third column of said primary array define successive image element tones that are substantially constant along said first and second dimensions at said minimum tonal value;

a first row security image segment in a fourth column of said primary array defines an image element tone that increases along said second dimension from said minimum tonal value to said tonal value i and that is substantially constant along said first dimension of said security image, where i is a value that is greater than said lower tonal value B and less than said tonal value A;

successive row security image segments in said fourth column of said primary array define successive image element tones that increase along said second dimension from said minimum tonal value to said tonal value j and that are substantially constant along said first dimension of said security image, where j is a value that is greater than said lower tonal value n and less than said tonal value m of a corresponding adjacent column successive row;

a first row security image segment in a fifth column of said primary array defines an image element tone that decreases along said first dimension from said tonal value A to said lower tonal value B and that is substantially constant along said second dimension of said security image;

successive row security Image segments in said first column of said primary array define successive image element tones that decrease along said first dimension from said tonal value m to said lower tonal value n and that are substantially constant along said second dimension of said security image, where said tonal value m is equal to a lower tonal value defined in the preceding security image segment in said first column;

a first row security image segment in a first column of said secondary array defines an image element tone that is substantially constant along said first and second dimensions at said minimum tonal value;

successive row security image segments in said first column of said secondary array define successive image element tones that are substantially constant along said first and second dimensions at said minimum tonal value;

a first row security image segment in a second column of said secondary array defines an image element tone that increases along said second dimension from said minimum tonal value to said tonal value i and that is substantially constant along said first dimension of said security image, where i is a value that is greater than said lower tonal value B and less than said tonal value A;

successive row security image segments in said second column of said secondary array define successive image element tones that increase along said second dimension from said minimum tonal value to said tonal value j and that are substantially constant j along said first dimension of said security image, where j is a value that is greater than said lower tonal value n and less than said tonal value m of a corresponding adjacent column successive row;

a first row security image segment in a third column of said secondary array defines an image element tone that decreases along said first dimension from said tonal value A to said lower tonal value B and that is substantially constant along said second dimension of said security image;

successive row security image segments in said third column of said secondary array define successive image element tones that decrease along said first dimension from said tonal value m to said lower tonal value n and that are substantially constant along said second dimension of said security image, where said tonal value m is equal to a lower tonal value defined in the preceding security image segment in said first column;

a first row security image segment in a fourth column of said secondary array defines an image element tone that decreases along said second dimension from said tonal value i to said minimum tonal value and that is substantially constant along said first dimension of said security image, where i is a value that is greater than said lower tonal value B and less than said tonal value A;

successive row security image segments in said fourth column of said secondary array define successive image element tones that decrease along said second dimension from said tonal value j to said minimum tonal value and that are substantially constant j along said first dimension of said security image, where j is a value that is greater than said lower tonal value n and less than said tonal value m of a corresponding adjacent column successive row;

a first row security image segment in a fifth column of said secondary array defines an image element tone that is substantially constant along said first and second dimensions at said minimum tonal value; and successive row security image segments in said fifth column of said secondary array define successive image element tones that are substantially constant along said first and second dimensions at said minimum tonal value.

15. A security document as claimed in claim 14 wherein:

said primary array defines at least four rows;

said tonal value m decreases from said tonal value B in a second row of said first column of said primary array to a tonal value C in a third row of said first column of said primary array to a tonal value D in a fourth row of said first column of said primary array; and said tonal value n decreases from said tonal value C in a second row of said first column of said primary array to said tonal value D in a third row of said first column of said primary array to a tonal value E in a fourth row of said first column of said primary array.

16. A security document as claimed in claim 15 wherein said tonal value i is substantially equal to (A+B)/2 and said successively lower tonal values j are substantially equal to (B+C)/2, (C+D)/2, and (D+E)/2.

17. A security document as claimed in claim 15 wherein said tonal value E and said minimum tonal value are substantially equal to zero.

18. A security document as claimed in claim 14 wherein said tonal value i is substantially equal to (A+B)/2 and said successively lower tonal values j are substantially equal to (m+n)/2.

19. A security document as claimed in claim 14 wherein said plurality of columns of said primary and secondary two dimensional arrays define a generally diagonal orientation relative to said first and second dimensions.

20. A security document processing system comprising a document issuing station and at least one document receiving station, wherein a security document originating at said document issuing station is routed to said document receiving station, said security document comprising a security image defined on a face of said document, wherein:

said security image is defined along first and second dimensions by the superposition of a primary security image portion and a secondary security image portion;

said primary security image portion is defined by security image elements of a first color;

said secondary security image portion is defined by security image elements of a second color;

said primary security image portion is arranged to include first, second, and third types of security image segments;

said secondary security image portion is arranged to include first, second, and third types of security image segments;

said first type of security image segment defines an image element tone that decreases along said first dimension of said security image and that is substantially constant along said second dimension of said security image;

said second type of security image segment defines an image element tone that decreases along said second dimension of said security image and that is substantially constant along said first dimension of said security image;

said third type of security image segment defines an image element tone that is substantially constant along said first and second dimensions of said security image; and said primary security image portion and said secondary security image portion are superposed such that (i) security image segments of said first type in said primary security image portion are superposed with security image segments of said third type in said secondary image portion, (ii) security image segments of said second type in said primary security image portion are superposed with security image segments of said second type in said secondary image portion, and (iii) security image segments of said third type in said primary security image portion are superposed with security image segments of said first type in said secondary image portion.

* * * * *

UNITED STATES PATENT AND TRADEMARK OFFICE

CERTIFICATE OF CORRECTION

PATENT NO. : 6,206,429 B1
DATED : March 27, 2001
INVENTOR(S) : Cull et al.

It is certified that error appears in the above-identified patent and that said Letters Patent is hereby corrected as shown below:

Column 12,
Line 5, "first color," should be -- first color; --.

Column 14,
Line 16, "element types," should be -- element types; --.

Column 16,
Line 11, "security image" should be -- security images --.

Signed and Sealed this

Twenty-second Day of January, 2002

*Attest:*

*Attesting Officer*

JAMES E. ROGAN
*Director of the United States Patent and Trademark Office*